US008998238B1

(12) United States Patent
Kato

(10) Patent No.: US 8,998,238 B1
(45) Date of Patent: Apr. 7, 2015

(54) MEAL-SERVING STOCK SHELF-EQUIPPED WHEELCHAIR

(71) Applicant: Protech Co., Ltd., Yokohama-shi, Kanagawa (JP)

(72) Inventor: Masahiro Kato, Yokohama (JP)

(73) Assignee: Protech Co., Ltd., Yokohama-Shi (JP)

( * ) Notice: Subject to any disclaimer, the term of this patent is extended or adjusted under 35 U.S.C. 154(b) by 0 days.

(21) Appl. No.: 14/213,083

(22) Filed: Mar. 14, 2014

(30) Foreign Application Priority Data

Jan. 17, 2014 (JP) ..... 2014-7240

(51) Int. Cl.
*A61G 5/10* (2006.01)

(52) U.S. Cl.
CPC ..... *A61G 5/10* (2013.01); *A61G 2005/1094* (2013.01)

(58) Field of Classification Search
CPC ..... A61G 2005/1094; A61G 5/10
USPC ..... 280/250.1, 304.1; 297/154, 155; 224/407
See application file for complete search history.

(56) References Cited

U.S. PATENT DOCUMENTS

| | | | | |
|---|---|---|---|---|
| 3,278,225 | A * | 10/1966 | Stine | 297/148 |
| 7,861,991 | B1 * | 1/2011 | Sylvertooth-Jackson | 248/274.1 |
| 8,496,260 | B2 * | 7/2013 | Jutkiewicz et al. | 280/250.1 |
| 2008/0041282 | A1 * | 2/2008 | Goschy et al. | 108/141 |

FOREIGN PATENT DOCUMENTS

GB 2370985 A * 7/2002

* cited by examiner

*Primary Examiner* — James English
(74) *Attorney, Agent, or Firm* — Barnes & Thornburg, LLP; Mark J. Nahnsen

(57) ABSTRACT

There is provided a meal-serving stock shelf-equipped wheelchair, with which the wheelchair user can efficiently perform meal-serving work when charged with the work, and in which the stock shelf is capable of being folded in a compact manner after the meal serving. The meal-serving motorized wheelchair includes: a wheelchair meal-serving table that is attached via a frame; and a meal-serving stock shelf that is engaged with an engaging plate via an engaging portion. The meal-serving stock shelf is structured by a raising and lowering mechanism powered by a motor and a dish tray storage section. The dish tray storage section stores dish trays of at least two levels disposed at a predetermined interval. The stock shelf can be folded in a compact manner when not in use.

7 Claims, 17 Drawing Sheets

MEAL-SERVING STOCK SHELF-EQUIPPED WHEELCHAIR

CLAIM FOR PRIORITY

This application claims priority to Japanese application number JP 2014-7240 filed on Jan. 17, 2014, which is herein incorporated by reference.

BACKGROUND OF THE INVENTION (1) Field of the Invention

The present invention relates to a wheelchair used for serving cooked food placed on trays.

(2) Description of Related Art

In order to facilitate advance and participation of persons with disabilities in society, the government and municipalities promote barrier-free public facilities. Further, usability of wheelchairs itself has been proposed.

For example, JP 2005-095692 A discloses the following. The wheelchair user operates the wheelchair himself/herself to make a turn in a narrow space. Making such a turn is inconvenient in a bathroom or a lavatory in homes. Accordingly, in consideration of a recent aging society and persons with disabilities, JP 2005-095692 A proposes a turntable for a wheelchair that reduces the burdens on the wheelchair user by allowing the wheelchair to change directions easier.

However, currently the work environment of wheelchair users is not fully improved to meet the social demand for employment promotion of wheelchair users. Further, there is no device for aiding wheelchair users in meal-serving work in restaurants.

The present disclosure has focused attention on this situation, and has worked on a wheelchair that would help the wheelchair users with advancement in society.

The present inventor has found the problem that, in the case where a wheelchair user performs meal-serving work using a conventional table-equipped wheelchair, the user can only serve a meal of a single person for each procedure, taking into consideration of the operation of the wheelchair.

SUMMARY OF THE INVENTION

In consideration of the problem described above, an object of the present disclosure is to provide a wheelchair with which the wheelchair user can efficiently perform meal-serving work when charged with the work, the wheelchair including a stock shelf body that can be folded in a compact manner after the meal serving.

A meal-serving motorized wheelchair according to a first aspect of the present disclosure is a meal-serving motorized wheelchair including: a meal-serving table that is attached via a frame; a meal-serving stock shelf that is engaged with an engaging plate via an engaging portion. The engaging plate is joined to a side frame of the motorized wheelchair. The meal-serving stock shelf is structured by a raising and lowering mechanism powered by a motor and a dish tray storage section. The dish tray storage section stores dish trays of at least two levels disposed at a predetermined interval. The raising and lowering mechanism raises and lowers the dish trays by being actuated by a belt and a pulley transferring power of the motor.

In connection with a meal-serving motorized wheelchair according to a second aspect of the present disclosure, in the first aspect of the present invention, the dish tray storage section has at least two hooks fixed to the belt at a predetermined interval. The dish trays are placed on the hooks when being stored in the dish tray storage section. The raising and lowering mechanism shifts the hooks to a predetermined served position by a single raising or lowering operation.

In connection with a meal-serving motorized wheelchair according to a third aspect of the present disclosure, in one of the first and second aspects of the present invention, the meal-serving stock shelf includes the raising and lowering mechanisms by two in number on both sides of the dish tray storage section. When the dish trays are stored in the dish tray storage section, the raising and lowering mechanisms are positioned perpendicularly to the engaging plate. When the dish trays are not stored in the dish tray storage section, the raising and lowering mechanisms inwardly rotate so as to be positioned substantially in parallel to the engaging plate, so that the meal-serving stock shelf can be folded in a compact manner when the stock shelf is not in use.

In connection with a meal-serving motorized wheelchair according to a fourth aspect of the present disclosure, one of the first to third aspects of the present disclosure further includes a lock mechanism that is actuated when the dish trays are stored in the dish tray storage section so as to immobilize the engaging portion.

In connection with a meal-serving motorized wheelchair according to a fifth aspect of the present disclosure, in one of the first to fourth aspects of the present disclosure, a height of the meal-serving table is positioned between a served position where each of the dish trays in the dish tray storage section is served and one of the dish trays that is lower than the served dish tray by one level, the height of the meal-serving table being lower than the served position.

According to the first aspect of the present disclosure, the meal-serving stock shelf is attached to the motorized wheelchair equipped with a meal-serving table. Then, the raising and lowering mechanism that is powered by a motor and that is built in the meal-serving stock shelf body automatically raises and lowers each dish tray to the position convenient for serving. Accordingly, the wheelchair user can perform meal-serving work without the necessity of taking uncomfortable posture. Further, since the dish tray storage section can store dish trays of at least two levels, meals for a plurality of persons can be efficiently served.

According to the second aspect of the present disclosure, the hooks are fixed at a predetermined interval to the belt that transfers the power of the motor, and the dish trays are placed on the hooks. Thus, a meal can be advantageously served without the necessity of having the dish tray slide sideways. Further, the raising and lowering mechanism automatically senses the position where the hooks are attached by a position detecting sensor, and raises or lowers the trays for each level. Accordingly, the wheelchair user can perform meal-serving work without being bothered by raising or lowering of the dish trays.

According to the third aspect of the present disclosure, the raising and lowering mechanisms are provided on both sides of the dish tray storage section of the meal-serving stock shelf so as to be opened and closed with the upper and lower engaging portions. Accordingly, when the dish trays are stored in the stock shelf, the raising and lowering mechanisms can be positioned perpendicularly to the engaging plate. When the dish trays are not stored in the stock shelf, the raising and lowering mechanism inwardly rotate so as to be positioned substantially in parallel to the engaging plate. Thus, the meal-serving stock shelf can be advantageously folded in a compact manner after meals are served.

According to the fourth aspect of the present disclosure, the meal-serving stock shelf can be opened and closed on both sides of the dish tray storage section. What is further included is a lock mechanism that is actuated when the dish trays are stored in the dish tray storage section so as to immobilize the upper and lower engaging portions. Thus, the dish tray storage section can be advantageously fixed during meal serving.

According to the fifth aspect of the present disclosure, the height of the meal-serving table positioned on the front side of the wheelchair is positioned between the served position where each of the dish trays in the dish tray storage section is served and one of the dish trays that is lower than the served dish tray by one level, the height of the meal-serving table being lower than the served position. Thus, the wheelchair user can easily shift the dish tray from the served position temporarily to the meal-serving table located slightly lower than the served position. Accordingly, it becomes possible for the wheelchair user to easily serve meals to the table positioned on the opposite side to the stock shelf body.

DETAILED DESCRIPTION OF PREFERRED EMBODIMENT

Figure 1:
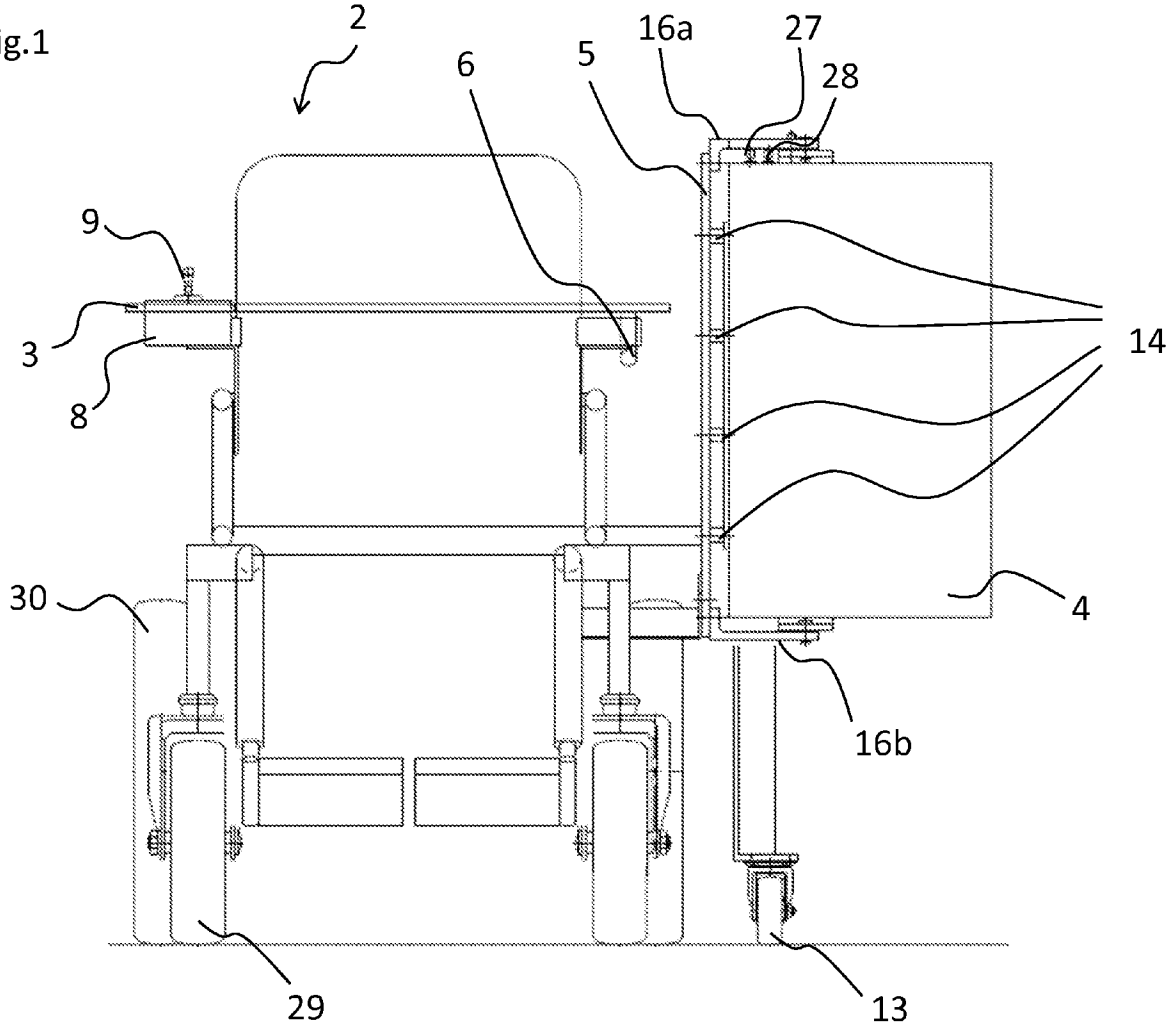
FIG. 1 is a front view of a wheelchair according to an embodiment of the present invention.

Next, with reference to the drawings, a description will be given of a meal-serving stock shelf-equipped wheelchair according to an embodiment of the present invention.

As shown in FIGS. 1 to 6, a meal-serving stock shelf-equipped wheelchair 1 of the present invention is structured by a wheelchair body 2, a wheelchair table (meal-serving table) 3, and a meal-serving stock shelf body 4 (also referred to as the stock shelf 4). As will be described in the following, the meal-serving stock shelf body 4 is used while being engaged to the wheelchair via an engaging plate 5 joined to the frame of the wheelchair.

A supporting pipe is fixed to the back face portion of the wheelchair table 3, and the wheelchair table 3 is engaged with a frame 6 so as to be rotatable about the pipe. Further, by allowing a separate frame to support part of the back face portion of the wheelchair table 3, the wheelchair user can use the wheelchair table for placing dishes thereon. Further, when a dish tray or the like is not to be placed on the wheelchair table 3, the wheelchair table 3 can be rotated about the pipe to stand upright in the vertical direction.

What is employed as the wheelchair 1 is a motorized wheelchair that can be driven by the user operating a self-propelling handle 9 provided on an operational box 8. Since the motorized wheelchair is equipped with the self-propelling handle 9, in consideration of its operability, the meal-serving stock shelf 4 is engaged on the side opposite to the self-propelling handle 9.

Figure 2:
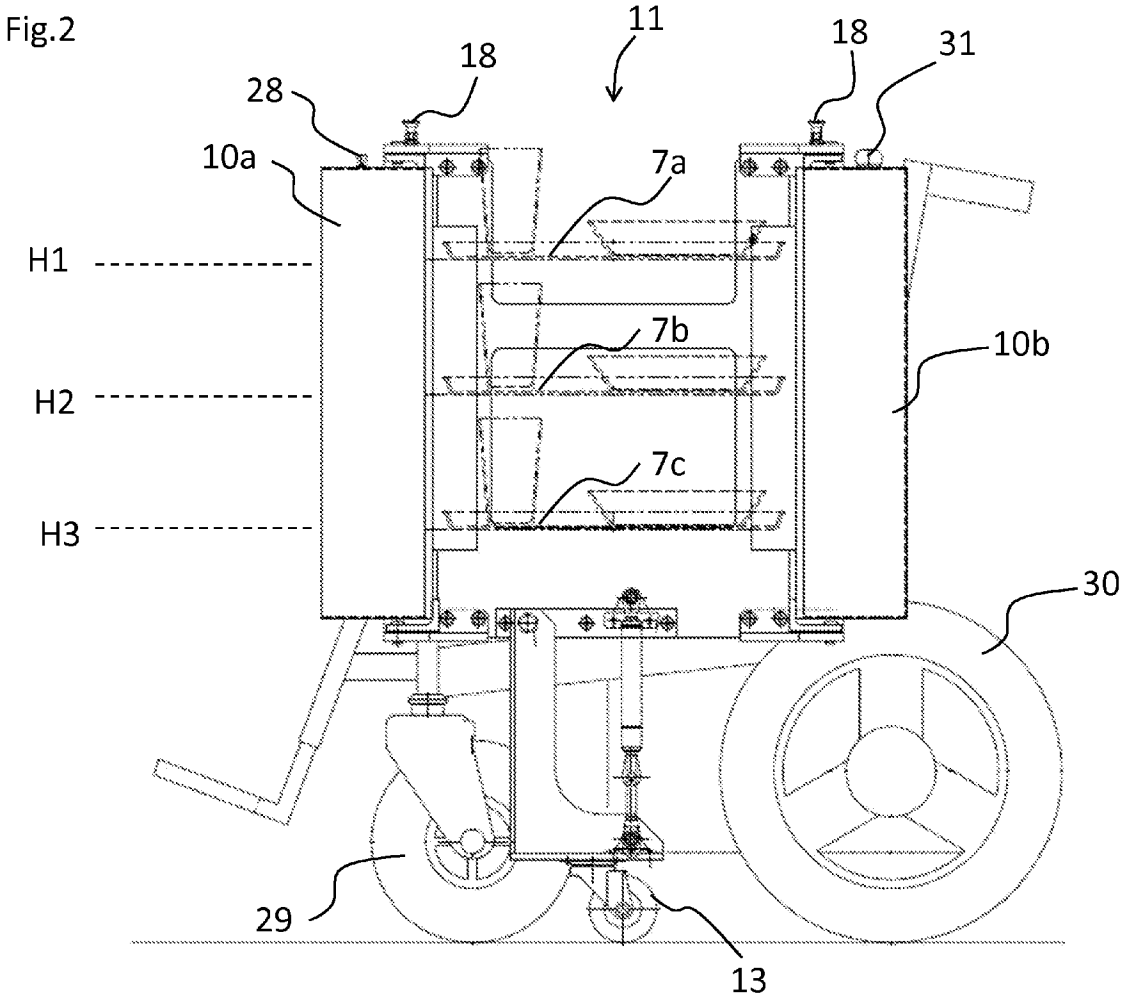
FIG. 2 is a side view of the wheelchair according to the embodiment of the present invention.
Figure 9:
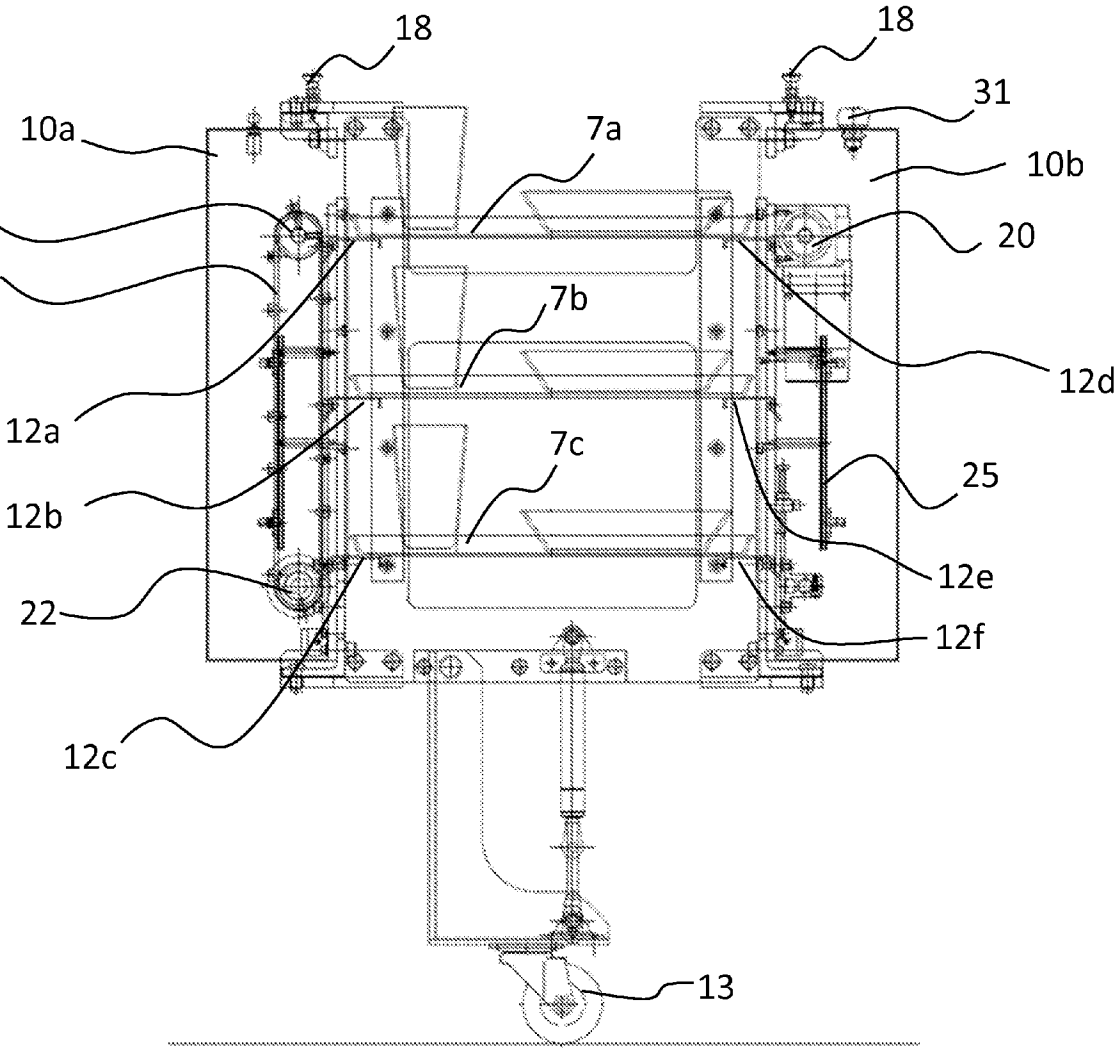
FIG. 9 is a left side view of the stock shelf body.

As shown in FIGS. 2 and 9, the stock shelf body 4 includes raising and lowering mechanisms 10 and a dish tray storage section 11. Note that, the raising and lowering mechanisms 10 are provided by two in number, i.e., a front raising and lowering mechanism 10*a* and a rear raising and lowering mechanism 10*b*. When the stock shelf 4 is used, dish trays 7 are stored in the space between the front and rear raising and lowering mechanisms 10.

As shown in FIG. 2, the dish trays 7 are stored at three levels in the dish tray storage section 11 of the stock shelf body 4. To a belt of each raising and lowering mechanism 10 of the stock shelf body 4, hooks 12 for the three levels are fixed. A dish tray 7 can be placed using a pair of hooks 12*a* and 12*d* (or a combination of 12*b* and 12*e* or 12*c* and 12*f*) that is fixed to the belt of each of the front and rear raising and lowering mechanisms and that is positioned at the same height. The front and rear raising and lowering mechanisms 10 each have a lifting function. The front and rear raising and lowering mechanisms 10 lift each dish tray 7 placed on the hooks and adjust the dish tray 7 to achieve a desired height, thereby aiding in the meal-serving work of the wheelchair user.

Note that, while the description has been given with reference to FIGS. 2 and 9 in which the dish tray storage section 11 includes the dish trays 7 of three levels, the dish tray storage section 11 that is capable of storing the dish trays 7 of at least two levels will suffice.

The stock shelf body 4 is provided with a stock shelf caster 13 so as to support the bottom portion of the stock shelf body 4. The caster of the stock shelf is located on the side closer to the wheelchair body 2 as shown in FIG. 2. Thus, the stock shelf caster 13 is disposed at the bottom portion where the weight is concentrated when the stock shelf body 4 is closed. Accordingly, the stability of the wheelchair 1 can be improved in a well-balanced manner.

(Attachment of Stock Shelf Body 4)

The stock shelf body 4 is engaged with the wheelchair 1 via the engaging plate 5 joined to the side frame of the wheelchair 1. The sides of the stock shelf body 4 and the engaging plate 5 are engaged with each other, and the top and bottom of the stock shelf body 4 and the engaging plate 5 are engaged with each other.

The sides of the stock shelf body 4 are fixed to the engaging plate 5 via back engaging portions 14. Further, the top and bottom of the stock shelf body 4 are engaged so as to allow the raising and lowering mechanisms 10 on both sides of the stock shelf body 4 to horizontally rotate.

(Rotary Structure)

Figure 13:
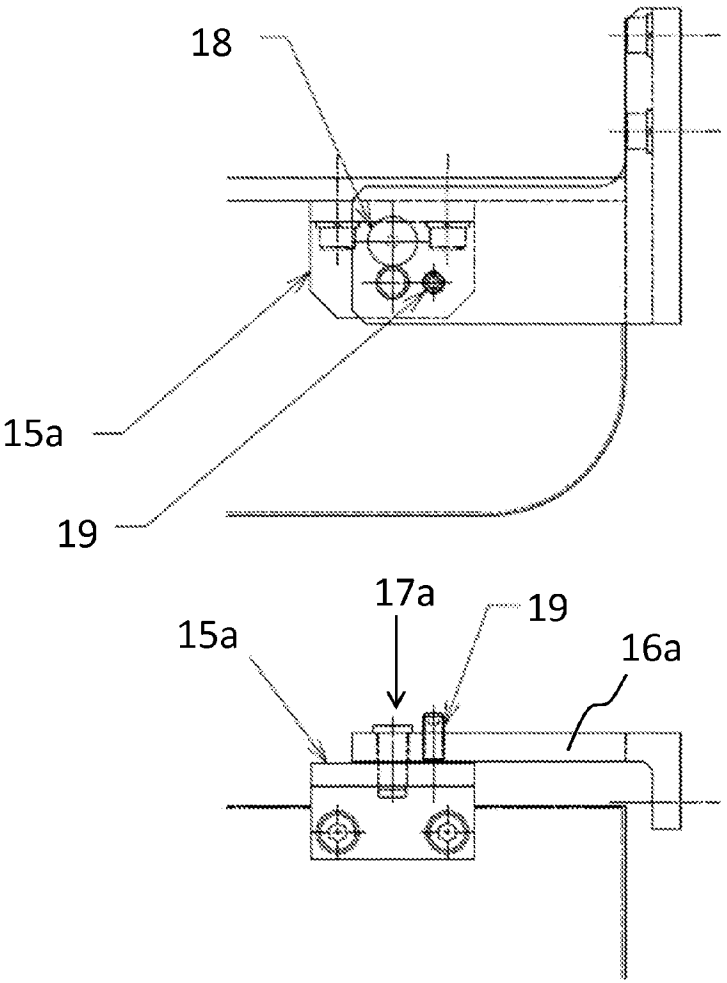
FIG. 13 is a detailed view of a top engaging portion when the stock shelf is in use.
Figure 14:
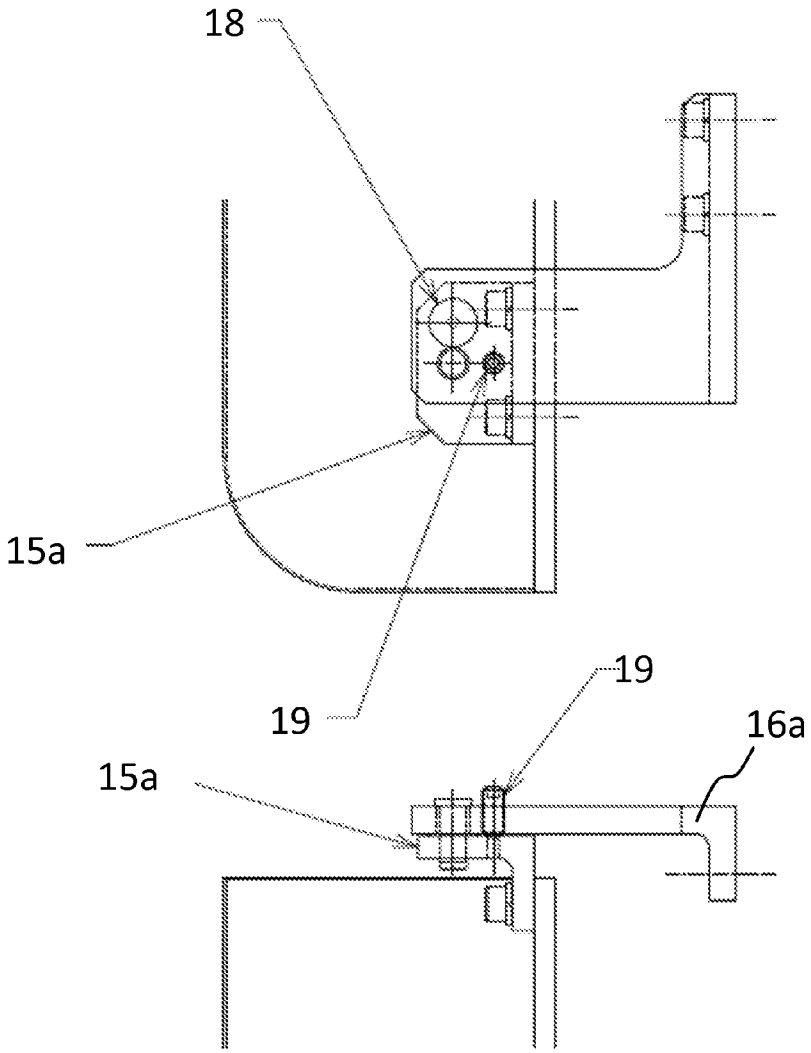
FIG. 14 is a detailed view of the top engaging portion when the stock shelf is not in use.

As shown in FIGS. 13 and 14, the engaging plate 5 and an upper bracket 15*a* of each raising and lowering mechanism 10 of the stock shelf body 4 are engaged with each other via an upper engaging plate 16*a*. The upper engaging plate 16*a* is fixed to the engaging plate 5. The upper engaging plate 16*a* and the upper bracket 15*a* are coupled to each other by an upper coupling pin 17*a* so as to be rotatable.

Similarly, the engaging plate 5 and a lower bracket 15*b* of each raising and lowering mechanism 10 of the stock shelf body 4 are engaged with each other via a lower engaging plate 16*b*. The lower engaging plate 16*b* is fixed to the engaging plate 5. The lower engaging plate 16*b* and the lower bracket 15*b* are coupled to each other by a lower coupling pin 17*b* so as to be horizontally rotatable.

With such a structure, the front and rear raising and lowering mechanisms 10 of the stock shelf body 4 can be opened or closed in a manner of double doors.

The front and rear raising and lowering mechanisms 10 can be used as being opened during meal serving. The front and rear raising and lowering mechanisms 10 can be closed in other situations, whereby the stock shelf body 4 can assume a compact mode.

(Lock Structure)

The top engaging portion is further provided with an index plunger 18 and a ball plunger 19 as a lock mechanism.

Figure 15:
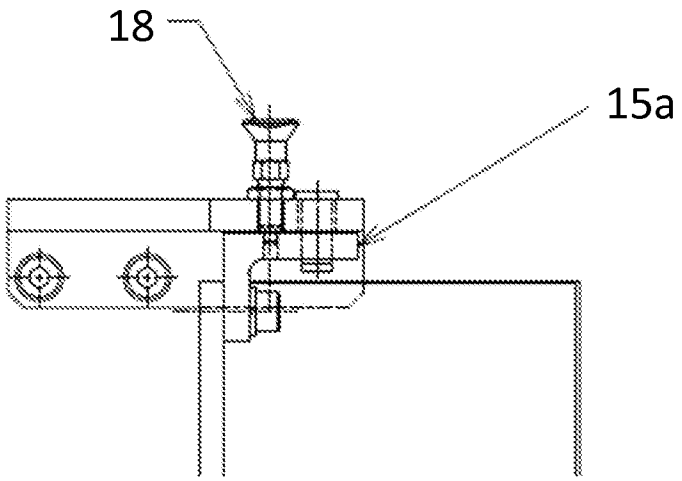
FIG. 15 is a side view of an index plunger when the stock shelf is in use.

As shown in FIGS. 13 and 15, when the stock shelf 4 is to be used, by allowing the raising and lowering mechanisms 10 on both sides of the stock shelf to be positioned perpendicularly to the engaging plate 5, the trays can be stored in the dish tray storage section. By allowing the nose of the index plunger 18 to be inserted into the pin insert hole of the upper bracket 15*a*, the raising and lowering mechanisms 10 can be fixed.

Figure 16:
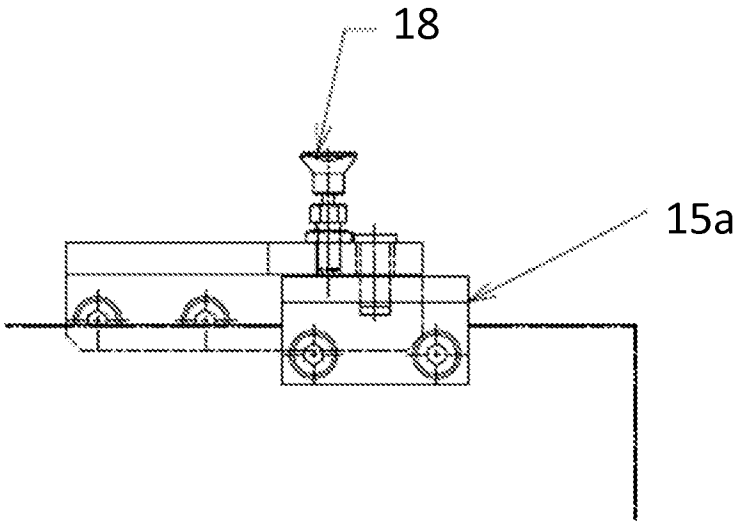
FIG. 16 is a side view of the index plunger when the stock shelf is not in use.

As shown in FIGS. 14 and 16, when the stock shelf 4 is not in use, the knob of the index plunger 18 is pulled upward to retract the nose, whereby fixation is released. After fixation is released, by allowing the raising and lowering mechanisms on both sides of the stock shelf to horizontally and inwardly rotate such that the raising and lowering mechanisms can be positioned substantially in parallel to the engaging plate 5, the stock shelf 4 can be folded in a compact manner. In the state where the stock shelf 4 is folded, since the ball of the ball plunger 19 presses the pin insert hole of the bracket, fixation is achieved by hooking. Since pressing of the ball plunger 19 is achieved by a spring, application of force thereto as it is allows the stock shelf 4 to horizontally rotate, when the stock shelf 4 is to be used.

(Structure of Raising and Lowering Mechanisms)

As shown in FIGS. 7 to 10, each of the raising and lowering mechanisms 10 includes a motor 20, a driving pulley 21 connected to the output shaft of the motor 20, a belt 23 that transfers the rotary force of the driving pulley 21 to a driven pulley 22, and the driven pulley 22. Note that, for the sake of convenience, though the driving belt is shown on the left side and the motor is shown on the right side in FIG. 9, the driving belt and the motor are disposed on each of the right and left sides symmetrically to form pairs.

Figure 10:
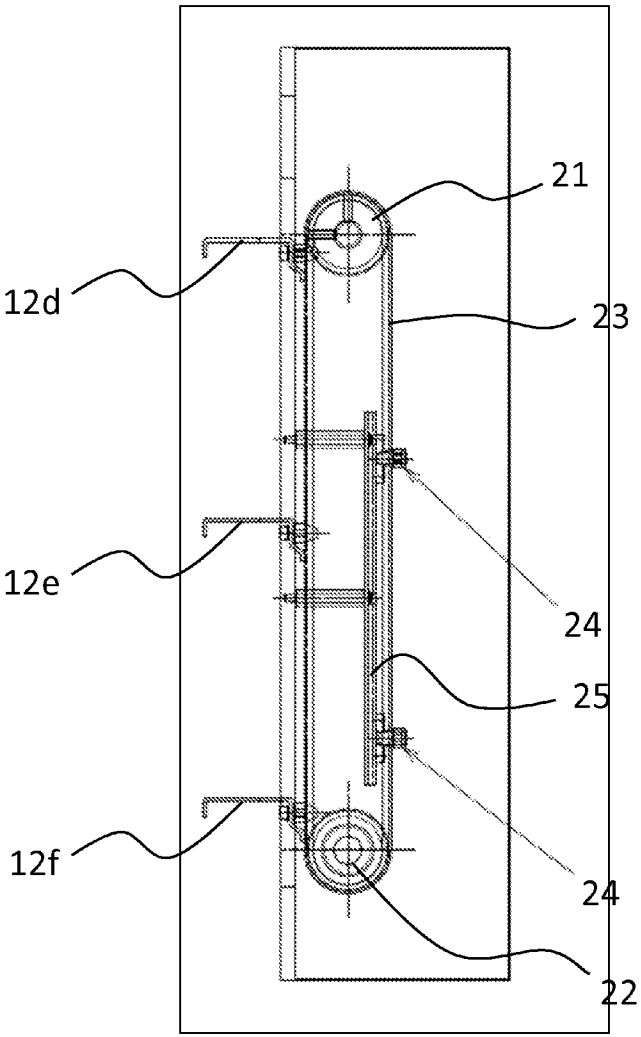
FIG. 10 is a side view of the raising and lowering mechanism.
Figure 11:
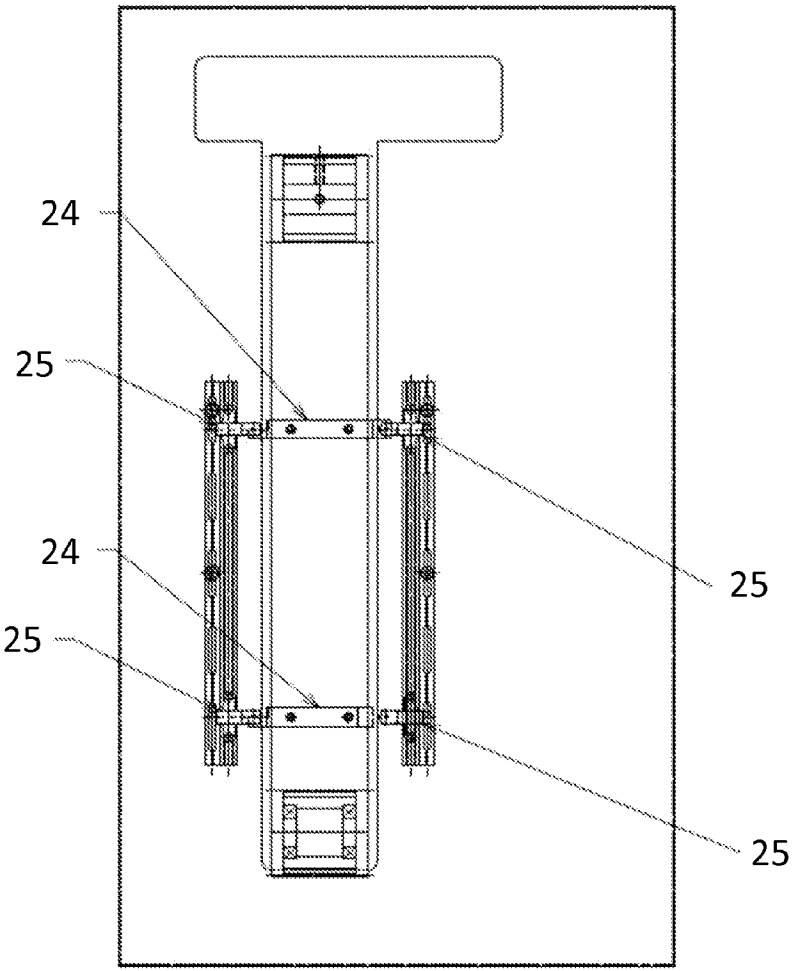
FIG. 11 is a front view of the raising and lowering mechanism.
Figure 12:
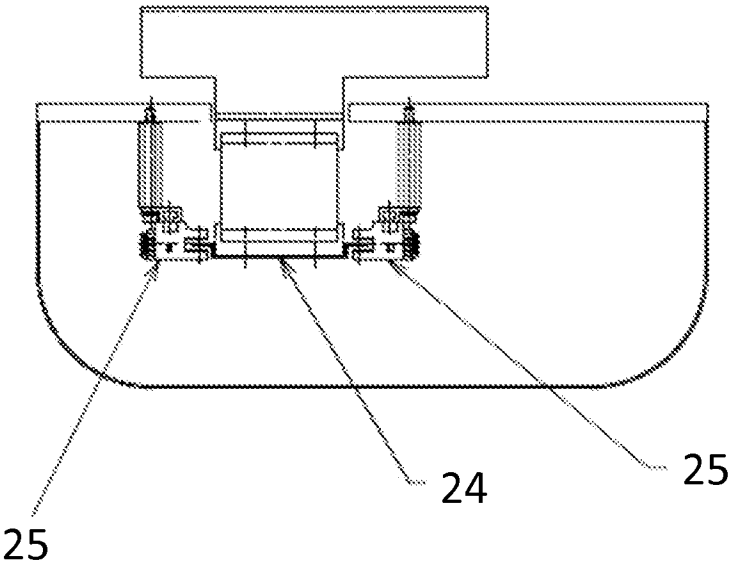
FIG. 12 is a top view of the raising and lowering mechanism.

As shown in FIG. 10, to each belt 23, hooks 12 for placing the trays 7 at constant intervals and flags 24 for detecting the position at predetermined intervals are fixed.

Figure 17:
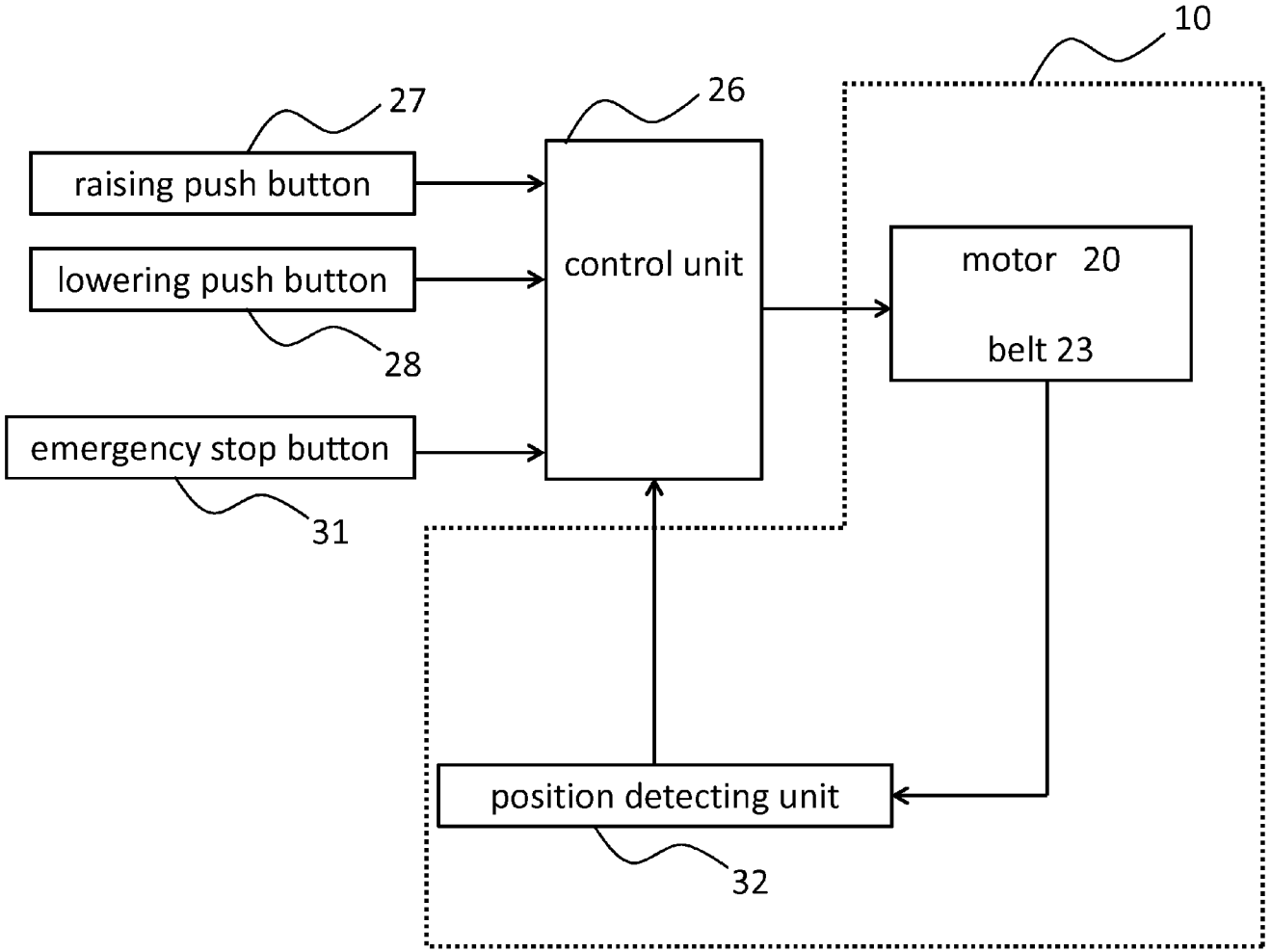
FIG. 17 is an explanatory diagram of a control unit in the raising and lowering mechanism.

Further, as shown in FIG. 17, the raising and lowering mechanisms 10 include a position detecting unit 32 that includes a position detecting sensor 25 for detecting the position of each dish tray 7.

The position detecting sensor 25 senses the flags 24 for shifting the dish trays 7 for each level by a predetermined interval, thereby detecting the position of the hooks 12. When the flags 24 arrive at a predetermined position, the position detecting sensor 25 senses the arrival and transmits positional information to a control unit 26.

The trays 7 are stored at three levels at constant intervals. Prior to the actuation of the raising and lowering mechanisms 10, the trays 7 are at the following positions in order from the top: a tray 7*a* at H1; a tray 7*b* at H2; and a tray 7*c* at H3.

(Raising Operation of Raising and Lowering Mechanisms)

When the raising push button 27 is pushed down, a raising operation (level raising operation) of the raising and lowering mechanisms 10 is performed by the control unit 26, which will be detailed later.

When the raising push button 27 is pushed down and the control unit 26 allows current to flow through the motor 20, the motor 20 rotates. The driving pulley connected to the rotary shaft of the motor 20 and the driven pulley rotate, to rotate the belt. Thus, the trays 7 placed on the hooks of the belt are raised. When the belt rotates to arrive at a predetermined position, the position detecting unit 32 having sensed the position of the hooks outputs a rotation stop signal to the control unit. Then, the control unit stops the current flowing through the motor 20.

For example, the flags 24 are disposed such that the distance traveled upward when the raising push button 27 is pushed down is as great as the interval between upper and lower trays 7. In the case where the raising push button is pushed down once when the trays 7 are at the initial position prior to the actuation of the raising and lowering mechanisms 10, the lowest tray 7*c* is raised from the height H3 to the height H2. When the raising push button is pushed down once more, the lowest tray 7*c* can be raised to the height H1.

(Lowering Operation of Raising and Lowering Mechanisms)

When the lowering push button 28 is pushed down, a lowering operation (level lowering operation) of the raising and lowering mechanisms 10 is performed by the control unit 26.

When the lowering push button 28 is pushed down, the control unit 26 allows current to flow through the motor 20 in the direction reverse to the case where the raising push button 27 is pushed down, whereby the motor 20 rotates in the direction reverse to the raising operation.

When the motor 20 reversely rotates, the driving pulley 21 connected to the rotary shaft of the motor 20 and the driven pulley 22 rotate in the reverse direction, to rotate the belt 23 in the reverse direction. Thus, the trays 7 placed on the hooks 12 of the belt 23 are lowered. When the belt 23 rotates to arrive at a predetermined position, the position detecting unit 32 having sensed the position of the hooks 12 outputs a rotation stop signal to the control unit 26. Then, the control unit 26 stops the current flowing through the motor 20.

Similarly to the raising operation, the flags 24 are disposed so that the distance traveled downward when the lowering push button 28 is pushed down once is as great as the interval between upper and lower trays 7. For example, in the case where the lowering push button is pushed down to start the lowering operation when the lowest tray 7*c* is at the position H1, the lowest tray 7*c* can be lowered to the position H2.

(Positional Control)

Further, when the lowest tray 7*c* is at the position H1/position H3, the position detecting unit 32 determines that the lowest tray 7*c* is at the upper limit/lower limit based on the position of the flags 24, and transmits an upper limit/lower limit positional information signal to the control unit 26. When the positional information signal is received, the control unit 26 does not allow the motor 20 to operate even when the raising/lowering push button is pushed down.

(Serving of Trays 7)

Since the trays 7 are raised and lowered in this manner, the wheelchair user can efficiently serve many trays 7 at once while sitting on the wheelchair 1.

Further, the position H1 (served position) of the tray 7 is designed to be slightly higher than the wheelchair table 3. For example, the height of the wheelchair table 3 is located between the position H1 of the tray 7 and the position H2, which is one level below the H1. This allows the wheelchair user who is to serve meals to temporarily shift the tray 7 easily from the position H1 to the wheelchair table 3 which is slightly lower than the position H1. For example, the wheelchair user can easily serve meals to a table that is positioned opposite to the stock shelf body 4.

Further, the stock shelf body 4 (the front and rear raising and lowering mechanisms 10) can be opened and closed in a manner of double doors, and the section between the front and rear raising and lowering mechanisms 10 is used as the dish tray storage section 11. Accordingly, each tray 7 can be lifted from the hooks 12 and taken out from the shelf as it is, without being slid.

(Structure of Dish Tray Storage Section 11)

Figure 3:
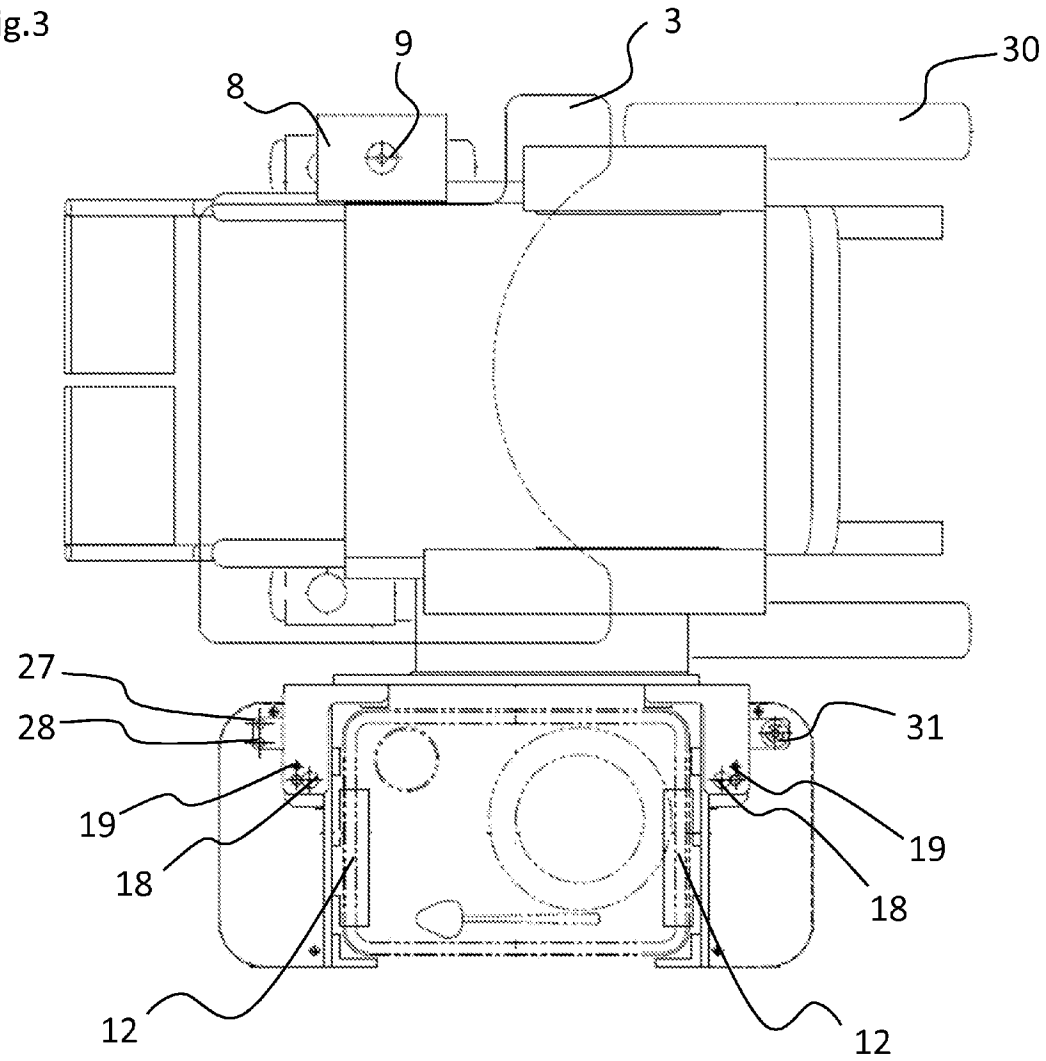
FIG. 3 is a top view of the wheelchair according to the embodiment of the present invention.
Figure 4:
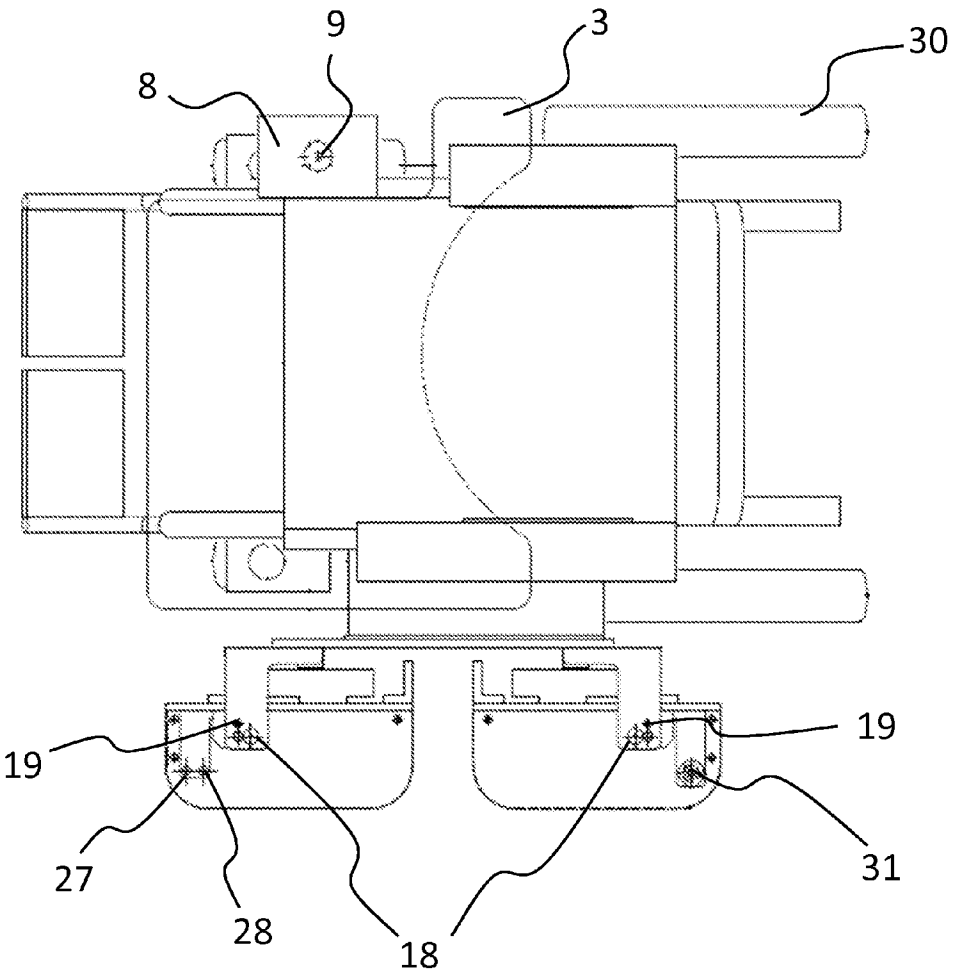
FIG. 4 is a top view of the wheelchair whose stock shelf body is folded.
Figure 5:
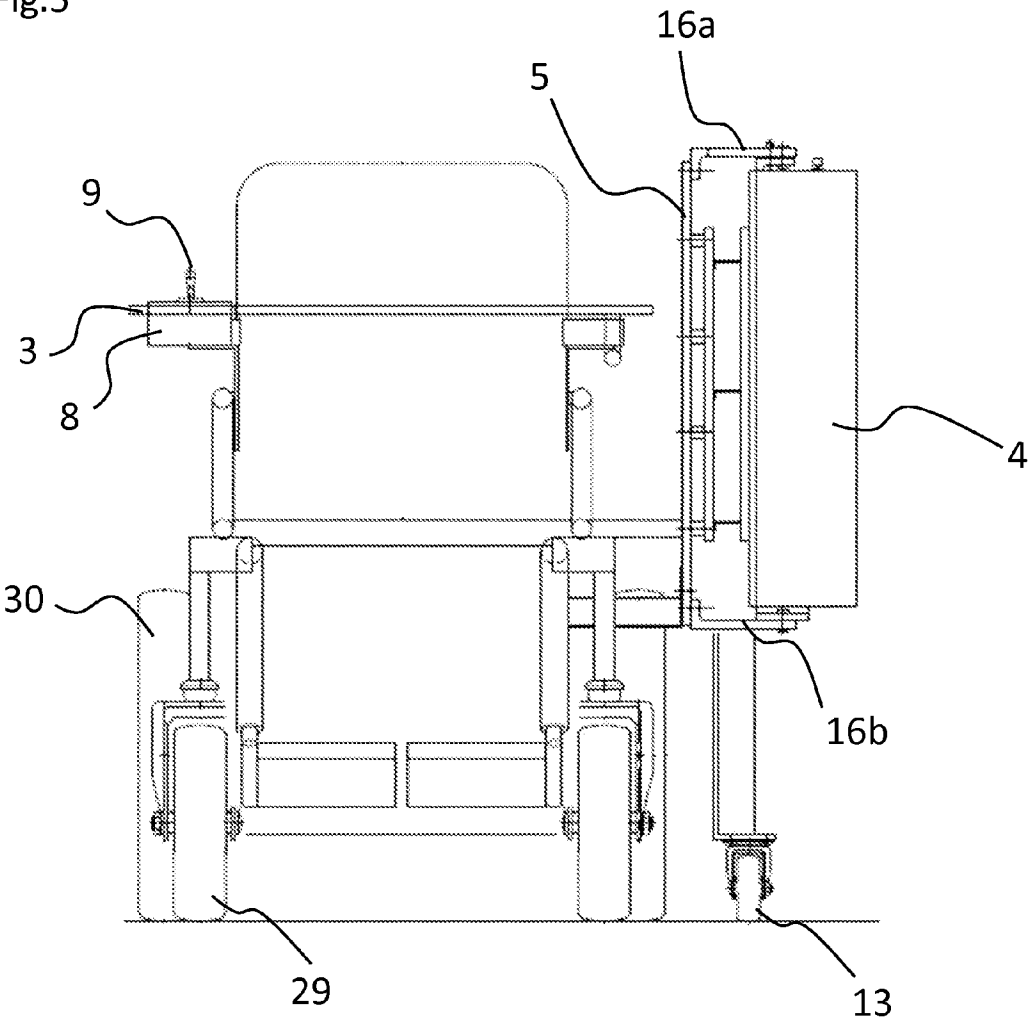
FIG. 5 is a front view of the wheelchair whose stock shelf body is folded.
Figure 6:
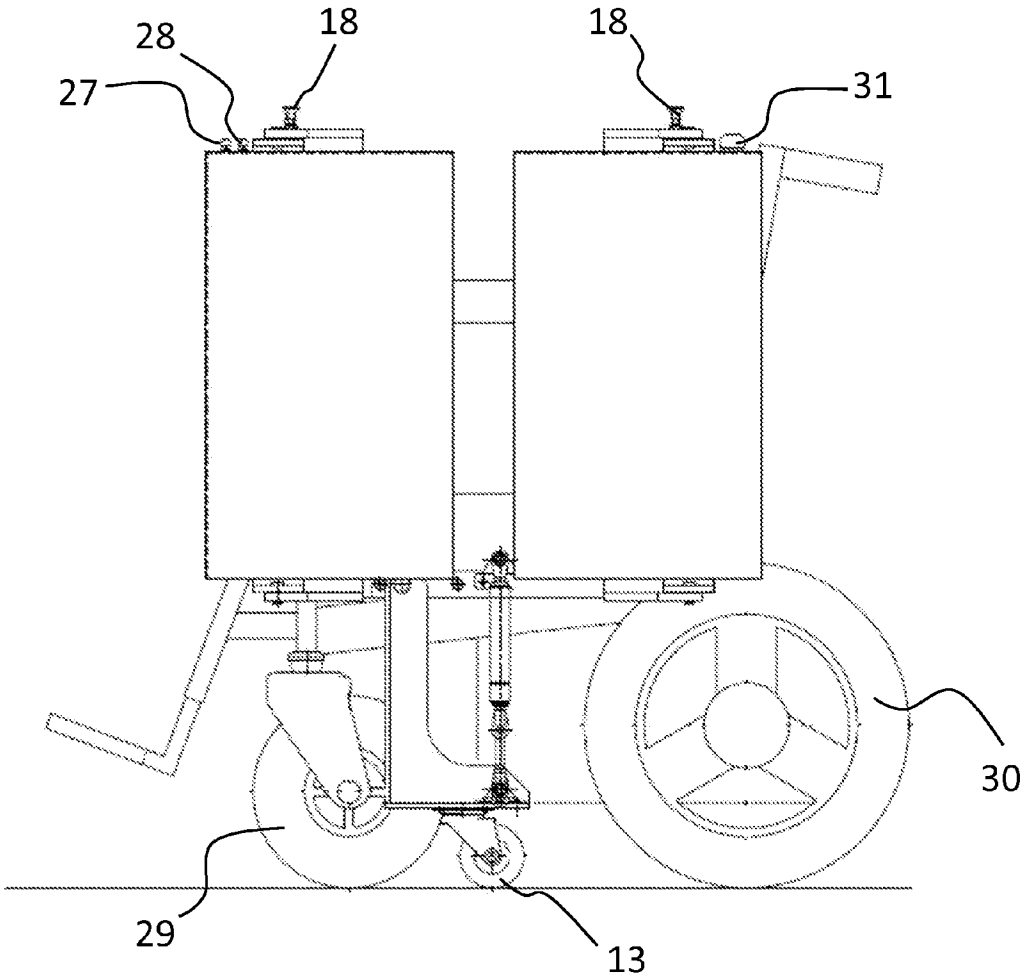
FIG. 6 is a side view of the wheelchair according to the embodiment whose stock shelf body is folded.
Figure 7:
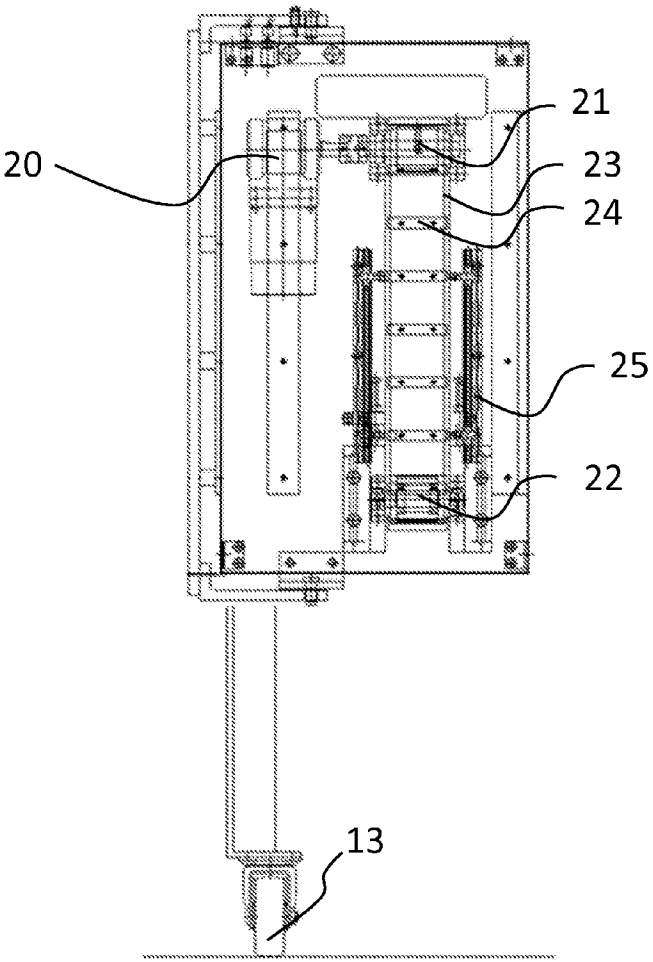
FIG. 7 is an explanatory view of a (front) raising and lowering mechanism of the stock shelf body.
Figure 8:
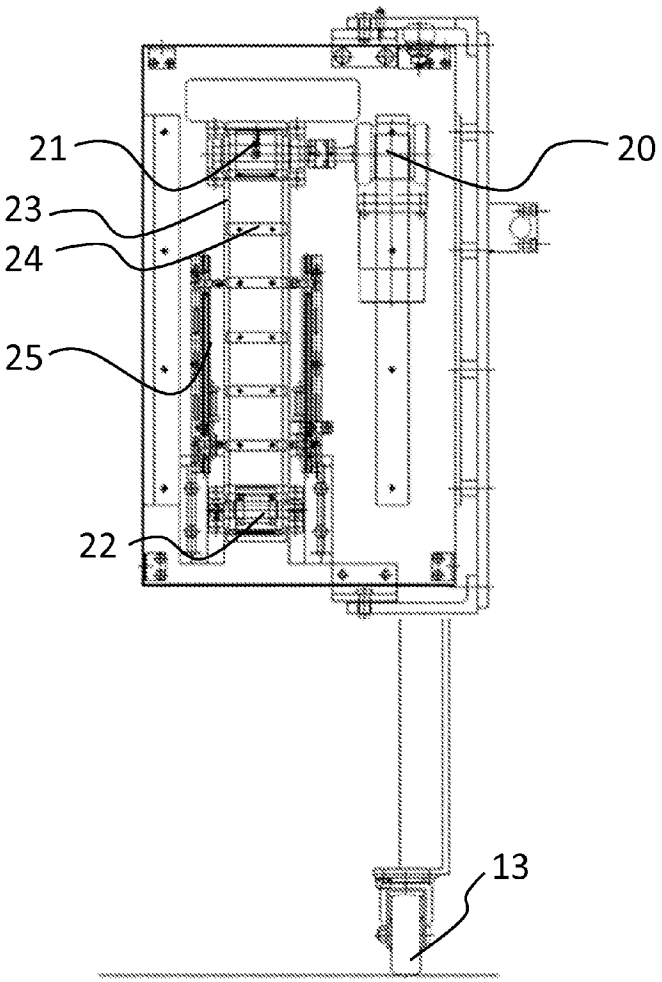
FIG. 8 is an explanatory view of a (rear) raising and lowering mechanism of the stock shelf body.

The section between the front and rear raising and lowering mechanisms 10 is used as the dish tray storage section 11. As shown in FIG. 3, the dish tray storage section 11 is set to be wider than the width between the front tire 29 and the rear tire 30 of the wheelchair. Since the dish tray storage section 11 is set as the section between the front and rear raising and lowering mechanisms 10, the space except for the places where the dish trays 7 are disposed is free and hence the wheelchair user's view is not obstructed. Accordingly, despite the dish tray storage section 11 being located beside the seated wheelchair user, a blind spot beside the wheelchair user can be eliminated.

That is, the dish tray storage section 11 is structured to be capable of being stored in a compact manner by being folded when not in use. Moreover, this structure contributes to safety of the wheelchair user when in use.

Since the section between the front and rear raising and lowering mechanisms 10 is used, the opposite side of the dish tray storage section 11 with reference to the wheelchair body 2 is also free space. Thus, not only the wheelchair user but also other meal-serving worker can easily place or take out the dish trays 7.

Further, in the case where a motorized wheelchair is used, vibrations may be transferred to the trays 7 while traveling. However, with this structure, since the trays 7 are placed on the hooks 12, space can be secured also in the vertical direction of the trays 7 as shown in FIG. 3. That is, with the meal-serving stock shelf-equipped wheelchair structured as described above, for example trays 7 each equipped with a cup holder, i.e., the trays whose bottom portion is not flat, can be used. This allows the wheelchair user to serve meals to tables while preventing food or drink spilling from the cup because of vibrations of the motorized wheelchair. Further, in the case where the wheelchair user serves hot soup or the like, the risk of the wheelchair user getting scalded with spilled hot soup can be reduced.

(Emergency Stop Button)

In case of emergency during the raising operation, the operation of the raising and lowering mechanisms 10 is stopped by the emergency stop button 31 being pushed down. When the emergency stop button 31 is pushed down, the control unit 26 urgently stops the flow of current to the motor 20. Thus, the rotation of the motor 20, that is, the raising and lowering mechanisms 10 can be stopped.

(Position of Buttons)

The raising push button 27 and the lowering push button 28 are disposed on the front raising and lowering mechanism 10*a*. The emergency stop button 31 is disposed on the rear raising and lowering mechanism 10*b*.

The raising push button and the lowering push button are pushed down by the wheelchair user during meal serving. Therefore, the buttons are disposed on the front raising and lowering mechanism 10*a* where the wheelchair user can push down the buttons safely while being seated on the wheelchair without incurring shifting of the center of gravity.

On the other hand, the emergency stop button 31 is disposed on the rear raising and lowering mechanism 10*b* taking into consideration of other serving workers pushing down the button during emergency. People are not often present in front of the wheelchair because it is normally the course of the wheelchair, and other serving workers or the like may be present behind the wheelchair. Therefore, such a disposition is useful not only for the wheelchair user but also for other people nearby.

The front and rear raising and lowering mechanisms 10 are caused to perform the raising and lowering operations and to urgently stop by the buttons associated with such respective functions. Though the position of the control unit 26 is not particularly limited, it is disposed in the space inside the front or rear raising and lowering mechanism 10, for example.

(Control System)

In connection with the control system in the present structure, the control unit 26 including a central processing unit is disposed in the space inside one of the front and rear raising and lowering mechanisms 10.

The control unit receives push-down signals from the raising push button 27, the lowering push button 28, and the emergency stop button 31, and positional information signals from the position detecting unit 32. The control unit 26 controls the operation of the motor 20 of each of the front and rear raising and lowering mechanisms 10 in accordance with the status of the signals, thereby raising or lowering the trays 7 or stopping the raising or lowering operation.

With the wheelchair according to the present embodiment, the wheelchair user can efficiently perform meal-serving work when charged with the work. Further, when the wheelchair is not used in serving meals, the stock shelf body 4 can be folded in a compact manner. Thus, the wheelchair can be widely used for the purposes other than meal serving.

The wheelchair user can efficiently perform meal-serving work when charged with the work, with the stock shelf body 4 capable of being folded in a compact manner after the meal serving. Thus, the present wheelchair allows the user to perform meal-serving work comparing favorably with able-bodied people.

While embodiments have been illustrated and described in the drawings and foregoing description, such illustrations and description are considered to be exemplary and not restrictive in character, it being understood that only illustrative embodiments have been shown and described and that all changes and modifications that come within the spirit of the disclosure are desired to be protected. The applicants have provided description and figures which are intended as illustrations of embodiments of the disclosure, and are not intended to be construed as constraining or implying limitation of the disclosure to those embodiments. There are a plurality of advantages of the present disclosure arising from various features set forth in the description. It will be noted that alternative embodiments of the disclosure may not include all of the features described yet still benefit from at least some of the advantages of such features. Those of ordinary skill in the art may readily devise their own implementations of the disclosure and associated methods, without undue experimentation, that incorporate one or more of the features of the disclosure and fall within the spirit and scope of the present disclosure.

What is claimed is:

1. A meal-serving motorized wheelchair comprising:

a meal-serving table that is attached via a frame; and a meal-serving stock shelf that is engaged with an engaging plate via an engaging portion, the engaging plate being joined to a side frame of the motorized wheelchair, wherein the meal-serving stock shelf is structured by a raising and lowering mechanism powered by a motor and a dish tray storage section, the dish tray storage section stores dish trays of at least two levels disposed at a predetermined interval, and the raising and lowering mechanism raises and lowers the dish trays by being actuated by a belt and a pulley transferring power of the motor.

2. The meal-serving motorized wheelchair according to claim 1, wherein the dish tray storage section has at least two hooks fixed to the belt at a predetermined interval, the dish trays are placed on the hooks when being stored in the dish tray storage section, and the raising and lowering mechanism shifts the hooks to a predetermined height by one of a level raising operation and a level lowering operation performed for a single time.

3. The meal-serving motorized wheelchair according to claim 1, wherein the meal-serving stock shelf includes the raising and lowering mechanisms by two in number on both sides of the dish tray storage section, when the dish trays are stored in the dish tray storage section, the raising and lowering mechanisms are positioned perpendicularly to the engaging plate, and when the dish trays are not stored in the dish tray storage section, the raising and lowering mechanisms inwardly rotate so as to be positioned substantially in parallel to the engaging plate, so that the meal-serving stock shelf is folded in a compact manner.

4. The meal-serving motorized wheelchair according to one of claim 1, further comprising a lock mechanism that is actuated when the dish trays are stored in the dish tray storage section so as to immobilize the engaging portion.

5. The meal-serving motorized wheelchair according to one of claim 1, wherein a height of the meal-serving table is positioned between a served position where each of the dish trays in the dish tray storage section is served and one of the dish trays that is lower than the served dish tray by one level, the height of the meal-serving table being lower than the served position.

6. A wheelchair comprising:

a chair having a seat portion and a back portion, the chair adapted to support a person;

a set of wheels to permit movement of the wheelchair;

a meal-serving table that is accessible to the person sitting in the chair;

a meal-serving stock shelf that is adapted to support food items and includes a raising and lowering mechanism and a dish tray storage section, wherein the raising and lowering mechanism raises or lowers the dishes or trays as selected by the person seated in the chair, and the dish tray storage section is adapted to hold dishes or trays and includes at least two levels.

7. The wheelchair of claim 6, wherein the meal-serving stock shelf can be moved from a folded position when not in use to an unfolded position when in use.

* * * * *